United States Patent [19]

Watanabe et al.

[11] 4,429,583

[45] Feb. 7, 1984

[54] LIQUID UPTAKE AND DISCHARGE APPARATUS

[75] Inventors: Mitsuo Watanabe; Shigeyuki Kimura; Hideki Konishi, all of Tokyo; Yasuhiro Tsuji; Kiyoshige Wakabayashi, both of Saitama, all of Japan

[73] Assignees: Chugai Seiyaku Kabushiki Kaisha; Japan Spectroscopic Co., Ltd., both of Tokyo, Japan

[21] Appl. No.: 362,161

[22] Filed: Mar. 26, 1982

[30] Foreign Application Priority Data

Mar. 31, 1981 [JP] Japan ..... 56-47368

[51] Int. Cl.[3] ..... G01F 11/06

[52] U.S. Cl. ..... 73/864.12; 73/864.17; 422/100

[58] Field of Search ..... 73/864.12, 864.16, 864.17, 73/864.18; 422/67, 81, 82, 100; 436/179, 180

[56] References Cited

U.S. PATENT DOCUMENTS

| | | | |
|---|---|---|---|
| 3,666,420 | 5/1972 | Paatssch | 73/864.25 |
| 4,101,283 | 7/1978 | Sundstrom | 422/100 |
| 4,231,990 | 11/1980 | Jottier | 422/81 |
| 4,299,794 | 11/1981 | Kelly et al. | 422/81 |

*Primary Examiner*—S. Clement Swisher

*Attorney, Agent, or Firm*—Fleit, Jacobson, Cohn & Price

[57] ABSTRACT

An apparatus for taking up and discharging liquid has at least one piston cylinder which responds to a command by taking up or discharging liquid, the arrangement being such that the number of liquid uptake operations is preset, with the piston cylinder being instructed to perform the discharge operation when the number of uptake operations actually performed is detected to exceed said preset number. A plurality of different liquid specimens can be mixed, and the mixture diluted when so desired, through a simple operation which assures great accuracy.

19 Claims, 17 Drawing Figures

11
DIGITAL SWITCH
36
12
DISCRIMINATORY COMMAND MEANS
PS
12a
(-)
PRESET COUNTER
U
33
PRESET LOAD SIGNAL GENERATOR
39
38
DELAY CIRCUIT
42
PULSE TRAIN GENERATOR
40
34
ON
UPTAKE GATING CIRCUIT
OFF
Sa
37
35
Sb
41
ON
DISCHARGE GATING CIRCUIT
OFF
Sf
101

REPETITION CONTROLLER
14
32
53
30
DRIVE COMMAND SIGNAL GENERATOR
10
26

LIQUID UPTAKE AND DISCHARGE APPARATUS

BACKGROUND OF THE INVENTION

1. Field of the Invention

This invention relates to an apparatus for taking up and discharging liquid and, more particularly, to an apparatus which is adapted to take up a variety of liquid specimens from corresponding vessels and subsequently discharge the liquid specimens into a separate vessel in order to mix the liquids and dilute the mixture when so desired.

2. Description of the Prior Art

It is frequently necessary in the analysis of serum or the like to sample specified quantities of various different liquids which are then mixed and diluted, when necessary. The conventional apparatus for this purpose, such as a diluting machine or autopipette, possesses an uptake and discharge function. In most of these known arrangements the uptake and discharge function is an unsophisticated one, in which one liquid specimen is drawn from its vessel and then immediately discharged into the awaiting separate vessel. This means that a discharge operation must follow each single uptake operation, and that this uptake-discharge cycle must be repeated a plurality of times in order to sample, mix and dilute a plurality of liquid specimens, as in the analysis of serum mentioned above. With the conventional apparatus, in other words, the liquids must be taken up and discharged one at a time through a troublesome procedure which is prone to error and likely to result in a low degree of accuracy.

BRIEF SUMMARY OF THE INVENTION

Accordingly, an object of the present invention is to provide a liquid uptake and discharge apparatus which, through a simple arrangement operable to take up a plurality of different liquids successively and then discharge the liquids, enables the liquids to be mixed together and, when desired, to be diluted, with great accuracy through a very simple operation.

According to the present invention, the foregoing and other objects are attained by providing a liquid uptake and discharge apparatus which comprises at least one piston cylinder having uptake and discharge functions, a drive unit for actuating the piston cylinder, and a control unit for controlling the drive unit. The control unit comprises (a) signal generating means for generating a drive command signal in response to which the piston cylinder executes a liquid uptake or discharge operation, (b) setting means for setting the number of liquid uptake operations to be executed by the piston cylinder, and (c) discriminatory command means for producing an uptake command signal in response to the drive command signal until the number of the drive command signals reaches the number of liquid uptake operations set by the setting means, and for producing a discharge command signal in response to the drive command signal when the number of the drive command signals exceeds the set number of liquid uptake operations.

Other objects, effects and characterizing features of the present invention will become apparent from the following description of preferred embodiments thereof taken in conjunction with the accompanying drawings in which like reference characters designate the same or similar parts through the figures thereof.

DESCRIPTION OF THE PREFERRED EMBODIMENTS

Figure 1:
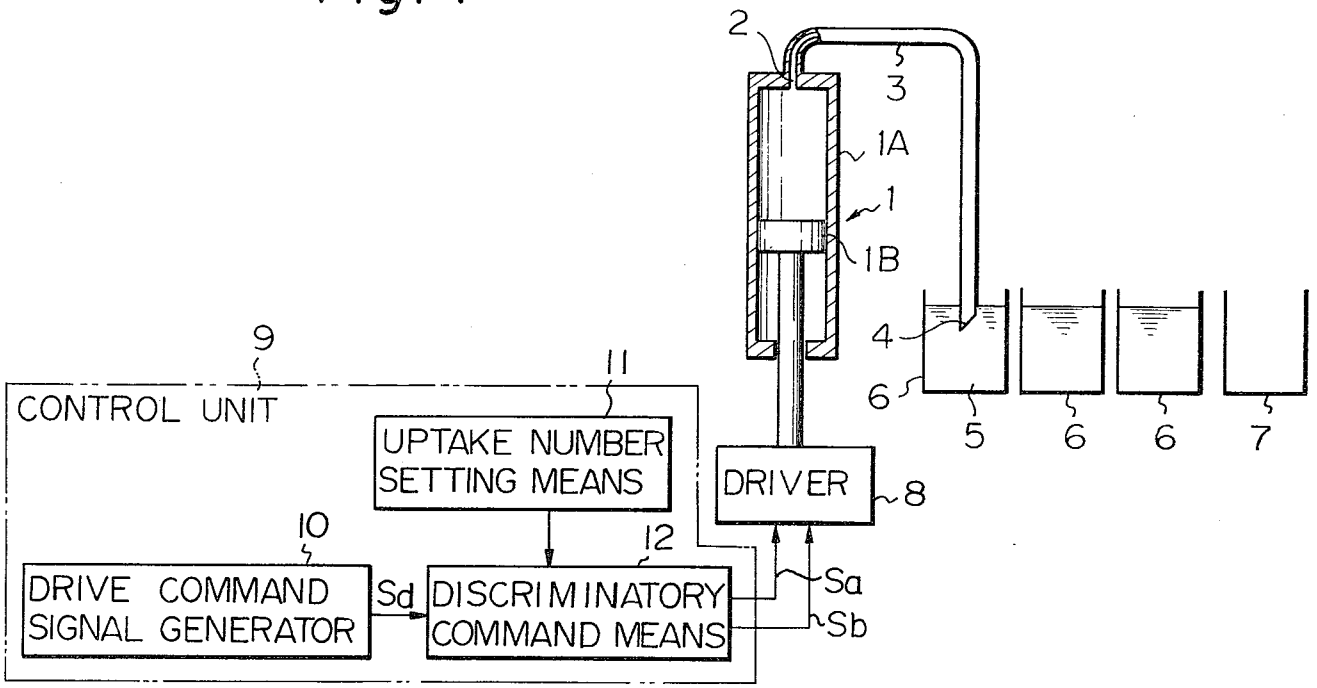
FIG. 1 is a block diagram showing the basic construction of a liquid uptake and discharge apparatus according to the present invention.

Reference will first be had to FIG. 1 to describe the operating principle and basic construction of the liquid uptake and discharge apparatus according to the present invention.

The apparatus includes a single piston cylinder 1 which functions to both take up and discharge liquid. The piston cylinder 1 has a cylinder body 1A one end of which is formed into an uptake and discharge port 2 having an attached coupling hose 3 which consists of a comparatively flexible material such as a fluoroplastic. The free end of the hose 3 defines a probe having an uptake and discharge opening 4 at its end. The probe opening 4 is introduced into any of a number of vessels 6 containing liquid specimens 5 in order to draw the liquid from that vessel, and is then introduced into a vessel 7 to discharge the mixture of liquids extracted from the vessels 6. In the illustrated example the probe opening 4 serves the dual purposes of taking up and discharging liquid. In an alternative arrangement separate uptake and discharge openings may be provided and employed selectively by means of a changeover valve.

The piston cylinder body 1A slidingly accommodates a piston 1B whose piston rod is coupled for drive to a drive unit 8 such as a pulsed motor, DC motor or hydraulic device. Connected electrically to the drive unit 8 for controlling its operation is a control unit 9.

The control unit 9 includes signal generating means 10 which is adapted to generate a drive command signal $S_d$ in response to which the piston 1B is retracted, or driven downwardly, for an uptake stroke, or advanced, or driven upwardly, for a discharge stroke, where the term "stroke" shall be taken to mean incremental movement of the piston 1B upward or downward, and not necessarily full displacement of the piston. Also provided are uptake stroke setting means 11 manipulated by the operator for setting the number of uptake strokes to be executed by the piston 1B, namely the number of times the piston is to be retracted incrementally. The control unit 9 further includes discriminatory command means 12 whose two inputs are the drive command signal $S_d$ from the signal generating means 10 and a signal indicative of the set number of uptake strokes, obtained from the setting means 11. The command means 12 is adapted to compare the number of drive command signals $S_d$ with the set number of uptake strokes, and to produce an uptake command signal $S_a$ in response to the drive command signal $S_d$ until the number of drive command signals reaches the preset number of uptake strokes, and a discharge command signal $S_b$ in response to the drive command signal $S_d$ when the number thereof exceeds the set number of uptake strokes.

The signal generating means 10 can be so arranged as to generate a drive command signal each time a push-button switch is depressed. Another possible arrangement would be to have only the first drive command signal generated by a manually operated switch, with subsequent command drive signals from the second onward being produced automatically upon completion of the immediately previous uptake stroke, or following the elapse of a fixed period of time. Naturally, it is possible to combine both features and select either of them as desired.

The uptake stroke setting means 11 can employ any suitable switch configuration, such as a ten-key switch or a push-button switch for entering the number of desired uptake strokes. The discriminatory command means 12 ordinarily would comprise an electronic circuit relying upon a preset or the like, but it is also possible to employ a contact mechanism such as a drivable rotary switch, as will be described and illustrated later in connection with a preferred embodiment of the present invention.

To gain a fuller understanding of the operation of the apparatus shown in FIG. 1, assume that the uptake stroke setting means 11 has been set to the numerical value "3". When the signal generating means 10 produces the first drive command signal $S_d$ in response to the manipulation of a manual switch or the like, the signal $S_d$ enters the discriminatory command means 12 which, upon comparing the count with the value "3" set in means 11 and finding that the latter is larger, produces the uptake command signal $S_a$. This signal is coupled to the drive unit 8 which responds by retracting the piston 1B a predetermined distance in order that the uptake and discharge opening 4 may induce a predetermined amount of the liquid into the cylinder from the vessel into which the probe has been introduced. Following a second manipulation of the manual switch or upon completion of the first uptake stroke, the signal generating means 10 produces a second drive command signal. When this occurs the discriminatory command means 12 responds just as described above to produce an uptake command signal $S_a$, so that a predetermined amount of a liquid is again induced into the cylinder through the hose 3 is the foregoing manner. This is repeated upon the generation of the third drive command signal, at which time the discriminatory command means 12 senses the coincidence between the number of generated drive command signals and the number set in the stroke setting means 11. When the fourth drive command signal is generated, therefore, the discriminator command means 12 issues the discharge command signal $S_b$ to which the drive unit 8 responds by advancing the piston 1B, whereby the liquid drawn into the cylinder 1 through the hose 3 by the just completed series of uptake operations is discharged into the vessel 7 from the open end 4 of the hose. Thus, since the discharge operation follows three consecutive uptake strokes in the case described, three different liquid specimens can be mixed in the cylinder 1 if the open end 4 of the hose 3 is dipped into a different liquid specimen just prior to each uptake stroke. Ordinarily, only a single discharge stroke follows a plurality of uptake strokes. In the illustrated example, therefore, the fifth drive command signal $S_d$ will initiate the uptake stroke for the next cycle of operation.

Figure 2:
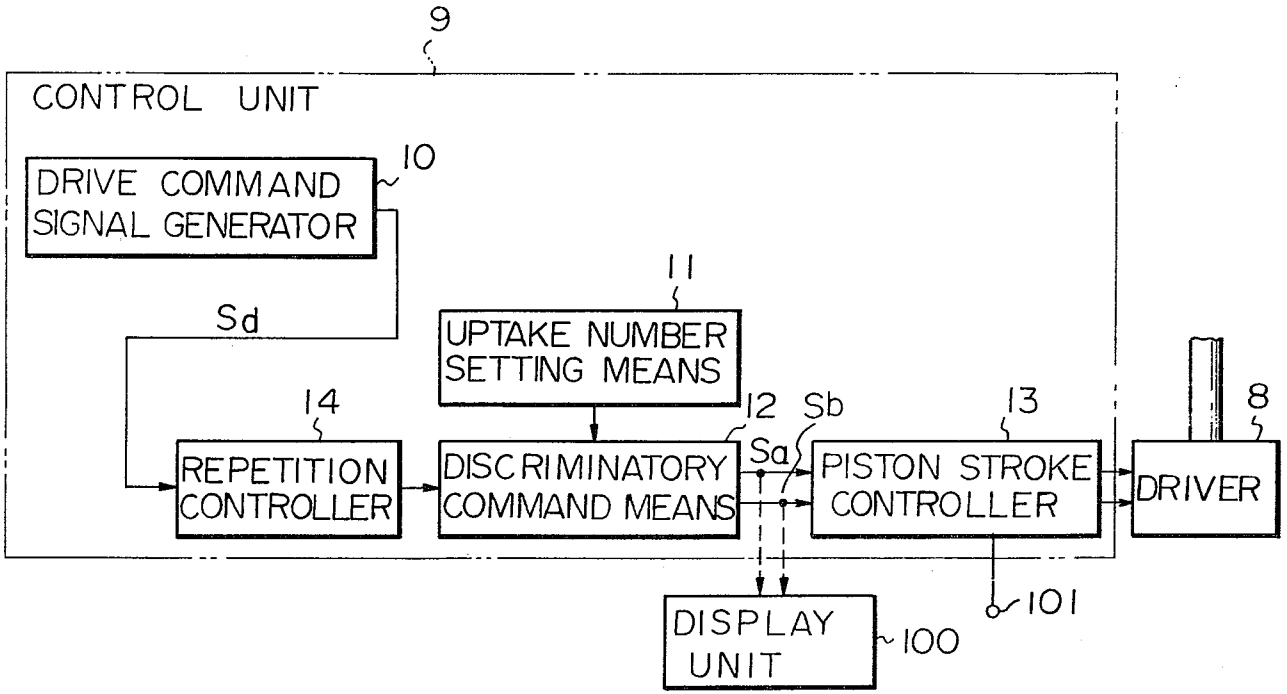
FIG. 2 is a block diagram showing an alternative arrangement for a control unit in the apparatus of FIG. 1.

The control unit 9 can be provided with a number of additional functions besides those described in connection with FIG. 1. FIG. 2 illustrates such an example of the control unit 9 in one mode of the present invention. Specifically, besides having the drive command signal generating means 10, uptake stroke setting means 11 and discriminatory command means 12, the control unit 9 is shown to include a piston stroke control means 13 which is adapted to control the piston stroke, namely the distance traversed by the piston 1B, in order to set the amount of liquid drawn in by a single action of the piston, and/or the amount of liquid discharged by a signal action of the piston, to a desired value, and repetition control means 14 for automatically repeating, a plurality of times, a set series of operations comprising a number of uptake strokes followed by a discharge stroke.

The piston stroke control means 13, which is connected between the discriminatory command means 12 and the drive unit 8, may be so arranged as to set the amount of liquid drawn in and/or discharged by one action of the piston 1B to any value, or to a particular value which it selects from a number of predetermined values. The piston stroke control means is provided with an external output terminal 101 for delivering a signal indicative of the completion of a discharge stroke. The signal can be used to immediately and automatically actuate a separately provided instrument, such as an analyzer of measuring device, upon the completion of the discharge stroke. In other words, the piston stroke control means 13 can be adapted to provide a signal which informs an auxiliary piece of equipment that a sampled specimen has been delivered to the vessel 7 for further processing.

The repetition control means 14, which is connected between the signal generating means 10 and the discriminatory command means 12, is operatively associated with a ten-key switch or the like which is used to set the number of desired repetitions of the abovementioned series of operations comprising the preset number of uptake strokes and subsequent discharge stroke. The repetition control means 14 is adapted to repeat said series of operations automatically a number of times determined by the ten-key switch or its equivalent. For example, the repetition control means 14 can be arranged to automatically supply the discriminatory command means 12 successively with the drive command signals from the drive command signal generating means 10 until the number of repetitions reaches the preset value. There may be cases, however, where it is not required or desired to repeat a series of operations in the automatic fashion described above. The repetition control means 14 therefore will advantageously be constructed to supply the discriminatory command means 12 only with individual ones of the drive command signals produced each time the manual switch of the signal generating means 10 is actuated, when this is the desired mode of operation.

In the arrangement of FIG. 2 a display device or indicator 100 is provided externally of the control unit 9 and is adapted to receive the uptake command signal $S_a$ or discharge command signal $S_b$ from the output signal of the discriminatory command means 12. The arrangement is such that an indicator lamp on the display device 100 will light when the uptake command or discharge command signal is generated, informing the operator of the current operating status of the apparatus.

Figure 3:
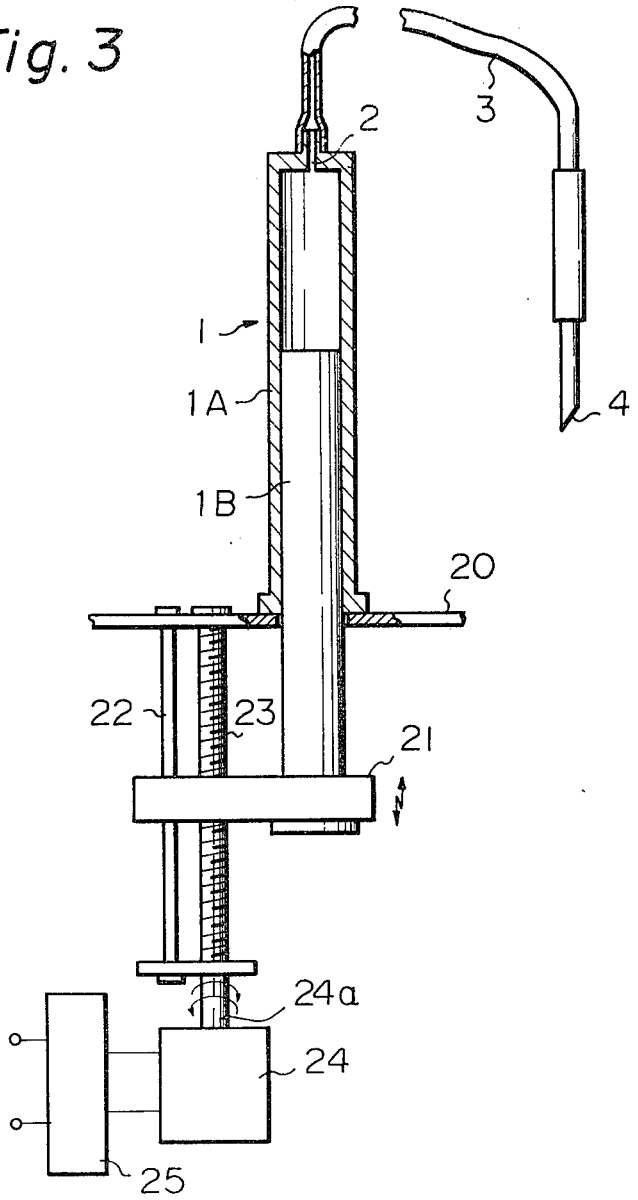
FIG. 3 is a front view of a first embodiment of the liquid uptake and discharge apparatus according to the present invention, in which a partial cut-away view depicts a principal portion of the mechanical part of the apparatus.
Figure 4A:
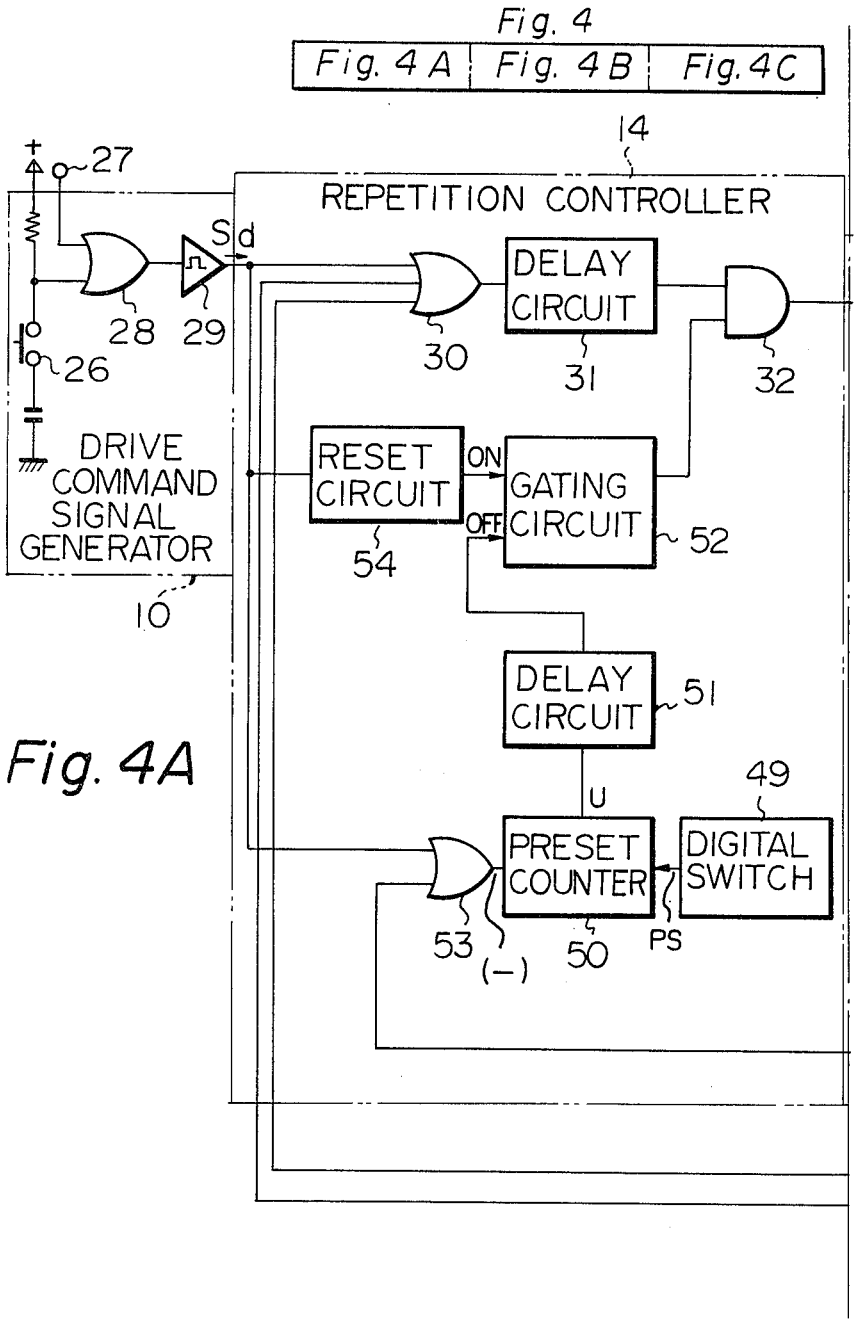
FIG. 4 is a block circuit diagram of the control unit, constituting part of the electrical circuitry of the invention, being divided into three parts, namely, FIGS. 4A, 4B and 4C.
Figure 4B:
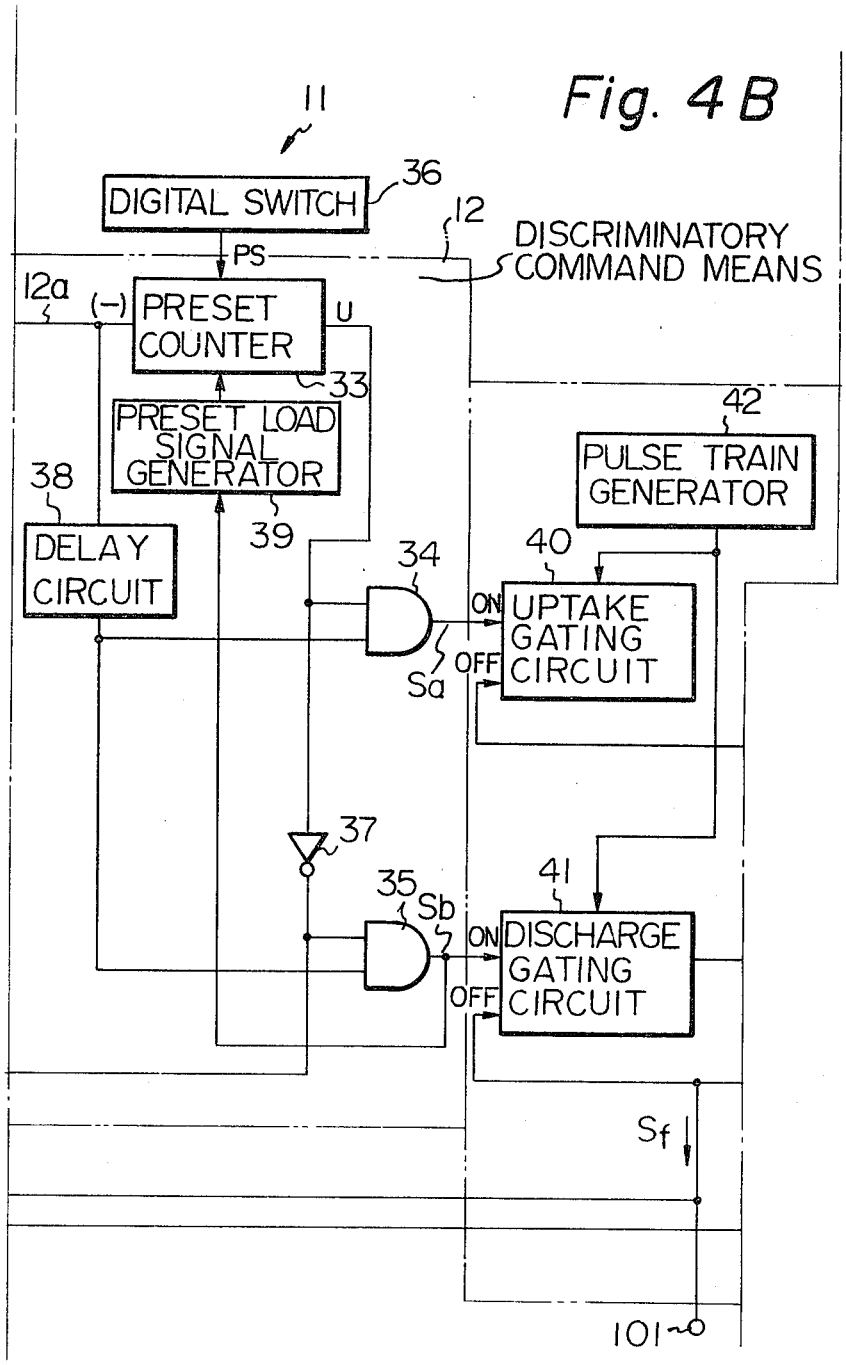
Figure 4C:
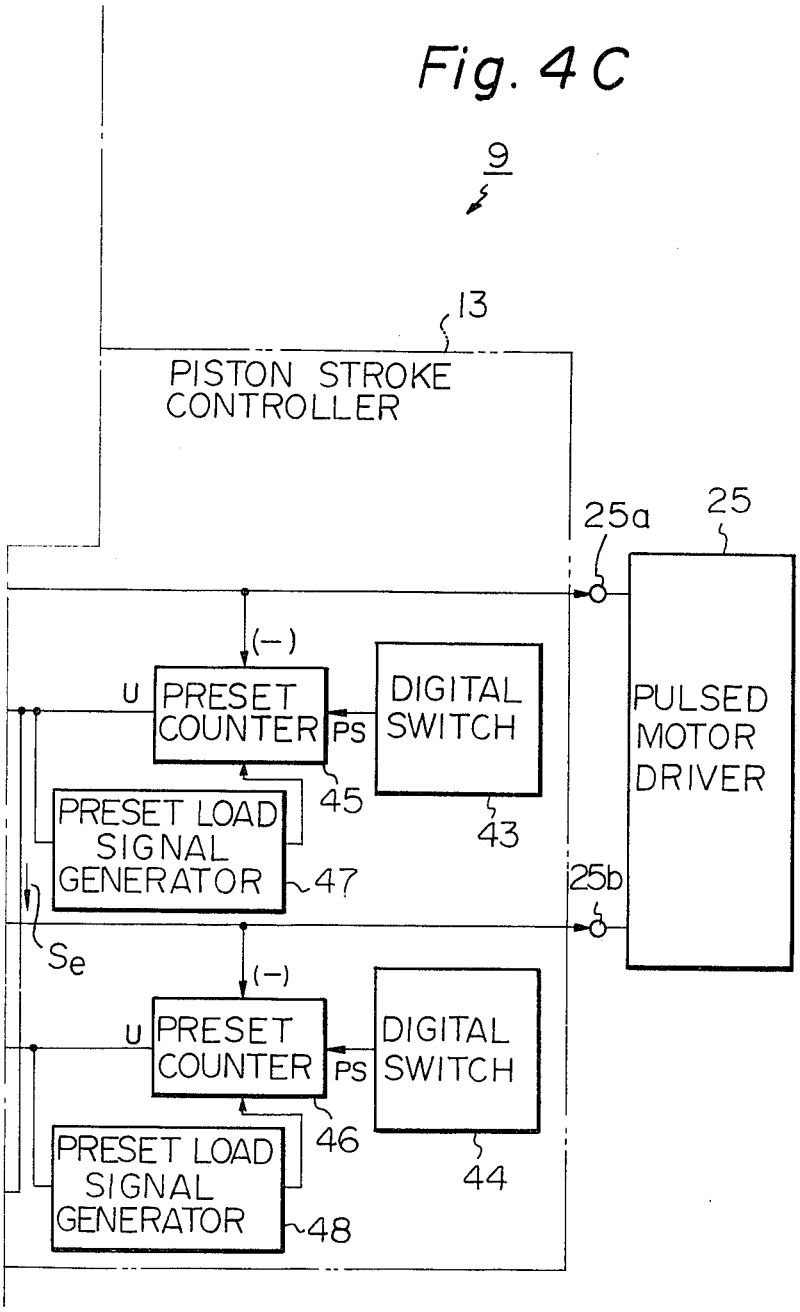

FIGS. 3 and 4 illustrate in greater detail a first embodiment of the inventive apparatus, wherein a pulsed motor is employed as the drive unit 8 for moving the piston 1B within the piston 1. Referring first to FIG. 3, the cylinder 1A of the piston cylinder 1 is vertically retained on a support 20, while the piston 1B is affixed at one end to an elevator base 21. The latter is raised or lowered by turning a vertical screw shaft 23 with which it is threadedly engaged, and is guided by means of a vertical guide rod 22. The screw shaft 23 is coupled to the drive shaft 24*a* of a pulsed motor 24, and hence rotates in unison with the drive shaft driven by the pulsed motor 24. Forward or clockwise rotation of the pulsed motor 24 causes the screw shaft 23 to lower the elevator base 21, reverse or counter-clockwise rotation causes the screw shaft to raise the elevator base. In the former case the piston 1B is retracted to take up the liquid specimen from the cylinder 1 via the hose 3 and open end 4 thereof, and in the latter it is advanced to discharge a liquid specimen into the cylinder in reverse order. The input side of the pulsed motor 24 is connected to the output side of a driver 25 which the piston stroke control means 13 of the control unit 9 provides with a pulse train for forward rotation of the pulsed motor, or a pulse train for reverse rotation of the pulsed motor. The driver 25 rotates the pulsed motor 24 stepwise in the direction and by the amount determined by these pulse trains.

Turning now to FIG. 4 for a detailed description of the control unit 9 in the first embodiment of the present invention, the drive command signal generating means 10 is constituted by a push-button switch 26 which is manually operable, an OR gate 28 whose two inputs are a signal produced by depressing the push-button switch 26, and a signal which enters from an external signal input terminal 27, and a Schmitt trigger buffer circuit 29 which is actuated by the output of the OR gate 28. The output of the signal generating means 10, namely the signal $S_d$ which is produced by the Schmitt trigger buffer circuit 29, is coupled to the discriminatory command means 12 through an OR gate 30, delay circuit 31 and AND gate 32 in the order mentioned, these being provided in the repetition control means 14 which will be described in further detail hereinbelow. The discriminatory control means 12 includes a preset counter 33 whose content is counted down by the signal which arrives from the signal generating means 10 via the repetition control means 14, a pair of AND gates 34, 34 an inverter 37, a delay circuit 38 and a preset load signal generating circuit 39. The preset counter 33 is preset to the number of uptake strokes set by a digital switch 36 which serves as the uptake stroke setting means 11 illustrated in FIGS. 1 and 2, and produces an underflow signal, described later, which is applied to one input terminal of the AND gate 34, and to one input terminal of the AND gate 35 following inversion by means of the inverter 37. The other input to each of the AND gates 34, 35 is the aforementioned signal from the repetition control means 14 following a delay applied by the delay circuit 38. The output of AND gate 35, namely the uptake command signal $S_b$, is applied to the preset load signal generating circuit 39 for generating a preset load signal which is applied to the load input terminal of the preset counter 33.

The output of AND gate 34, namely the uptake command signal $S_a$, is connected to the input side of the piston stroke control means 13, specifically to the GATE ON terminal of an uptake gating circuit 40. Likewise, the discharge command output signal $S_b$ of the AND gate 35 is connected to the GATE ON terminal of a discharge gating circuit 41 provided on the input side of the piston stroke control means 13. The piston stroke control means 13, besides the uptake and discharge gating circuits 40, 41, includes a pulse train generating circuit 42 for generating a raw pulse train composed of pulses used to drive the pulsed motor 24, a digital switch 43 for specifying uptake stroke quantity, which switch is externally manipulated to set the amount of a liquid specimen taken up into the cylinder 1 by a single action of the piston 1B, a digital switch 44 for specifying discharge stroke quantity, which switch is also externally manipulated to set the amount of liquid discharged from the cylinder 1 by a single action of the piston 1B, a preset counter 45 which is preset to a number of pulses that corresponds to the uptake quantity set by the digital switch 43, a preset counter 46 which is preset to a number of pulses that corresponds to the discharge quantity set by the digital switch 44, and preset load signal generating circuits 47, 48 for loading the preset counters 45, 46, respectively.

The raw pulse train generated by the pulse train generating circuit 42 is applied to the uptake and discharge gating circuits 40, 41, respectively. The uptake gating circuit 40 applies the signal as the forward-rotation pulse train to the pulse motor driver 25 which receives the pulse train at a forward-rotation input terminal 25*a*. The forward-rotation pulse train is applied also to the preset counter 45 at its count-down input terminal. The underflow output U of the preset counter 45 is delivered to the GATE OFF terminal of the uptake gating circuit 40, and to the input side of the preset load signal generating circuit 47. The discharge gating circuit 41, on the other hand, applies the raw pulse train as the reverse-rotation pulse train to the pulse motor driver 25, which receives the pulse train at a reverse-rotation input terminal 25*b*. The reverse-rotation pulse train enters also the preset counter 46 at its count-down input terminal. The underflow output U of the preset counter 46 is applied to the GATE OFF terminal of the discharge gating circuit 41, and to the input side of the preset load signal generating circuit 48.

The repetition control means 14, besides the aforementioned OR gate 30, delay circuit 31 and AND gate 32, includes a digital switch 49 for externally setting the number of repetition of a series of operations comprising a plurality of uptake strokes and a subsequent discharge stroke, a preset counter 50 to the number of repetitions set by the digital switch 49, a delay circuit 51, a gating circuit 52 having a GATE OFF terminal which receives the underflow output U of the preset counter 50 through the delay circuit 51, an OR gate 53 and a reset circuit 54. Th preset counter 50 has a count-down input terminal which receives, through the OR gate 53, the output $S_d$ of the drive command signal generating means 10, or the output of the inverter 37 in the discriminatory command means 12. The gating circuit 52 also has a GATE ON terminal which receives the output of the drive command signal generating means 10 through the intermediary of the reset circuit 54. The output of gating circuit 52 is applied to one input terminal of the AND gate 32, whose other input is the signal from the delay circuit 31. The OR gate 30 has three inputs, one of which is the output $S_d$ from the signal generating circuit 10, as mentioned above. The other two inputs are the underflow signals U produced by the preset counters 45, 46 in the piston stroke control means 13.

In the operation of the control unit 9 depicted in FIG. 4, assume that the digital switch 36 for setting the number of uptake strokes has been preset to the numerical value "3", and that desired uptake and discharge quantities have been preset in the digital switches 43, 44 for specifying these quantities, respectively. Further, assume that the repetition number setting switch 49 has initially been set to zero.

When the operator depresses the push-button switch 26 under the conditions defined above, the Schmitt trigger buffer circuit 29 in the signal generating means 10 produces the drive command signal $S_d$, which is a single pulse corresponding to the single operation of the switch 26. The signal $S_d$ is delivered by the OR gate 30 to the delay circuit 31 which delays the signal before applying it to one input terminal of the AND gate 32. The drive command signal $S_d$ also is fed directly from the buffer circuit 29 to the reset circuit 54 and thence to the GATE ON terminal of the gating circuit 52, which responds by delivering a signal to the other input terminal of the AND gate 32. Since both inputs to AND gate 32 are now high (logical "1") by virtue of the signals arriving from the delay circuit 31 and gating circuit 52, the gate opens to deliver the drive command signal pulse $S_d$ from the output of the delay circuit 31 to the count-down input terminal of the preset counter 33, and to the AND gates 34, 34 through the delay circuit 38, in the discriminatory command means 12. Further, the drive command pulse $S_d$ also is fed directly from the buffer circuit 29 to the OR gate 53 which then delivers the pulse to the count-down input terminal of the preset counter 50. The preset counter 50 will have been preset to zero by the digital switch 49, in accordance with the initially setting of switch 49 as described above. When the drive command pulse $S_d$ arrives at the count-down input terminal, therefore, the preset counter 50 produces an underflow pulse U which is coupled to the GATE OFF terminal of gating circuit 52 after being delayed by the delay circuit 51 (that is, after the output from the gating circuit 52 has gone high). The output of gating circuit 52 consequently goes low, removing the signal that opens the AND gate 32.

When the drive command pulse $S_d$ appears at the count-down terminal of the preset counter 33 in the discriminatory command means 12 as described above, the content of the preset counter is counted down, or decremented, by one step. Since the counter will have been preset to the numerical value "3" in accordance with the aforementioned setting of the digital switch 36 for the number of uptake strokes, its content will now have a value of "2" owing to the arrival of the pulse $S_d$. Since the content of preset counter 33 is non-zero, no underflow pulse is produced so that the level of the underflow pulse output terminal is of a polarity which is opposite to that of the overflow pulse. This polarity at the overflow output terminal causes the AND gate 34 to open, but holds the AND gate 35 closed owing to the intervention of the inverter 37. As a result, the drive command pulse $S_d$ coupled to the AND gates 34, 35 via the delay circuit 38 is passed solely by the AND gate 34 and enters the piston stroke control means 13 as an uptake command signal $S_a$ which is applied to the GATE ON terminal of the uptake gating circuit 40, the latter being opened as a result. This permits the passage of the pulse train from the pulse train generating circuit 42 to the forward-rotation input terminal 25*a* of the pulsed motor driver 25 which responds by rotating the pulsed motor 24 in the forward direction. The piston 1B is thus retracted to induce a liquid specimen into the piston 1.

The pulse train passed by the uptake gating circuit 40 is applied also to the count-down input terminal of the preset counter 45 whose content is preset to a value set by the digital switch 43 for specifying the uptake quantity, namely to a value which corresponds to the amount of a liquid specimen which is desired to be taken up by a single action of the piston. When the number of pulses in the arriving pulse train surpasses this value, the preset counter 45 produces an underflow pulse U which is transmitted to the GATE OFF terminal of the uptake gating circuit 40 to gate the circuit closed. As a result, the pulse train from circuit 42 is no longer provided to the pulse motor driver 25, the pulsed motor coming to rest to halt the uptake stroke of the cylinder 1. Thus, when a single uptake stroke is being implemented owing to the forward-rotation pulses delivered to the pulsed motor driver 25, the preset counter 45 subtracts these pulses from the number set by the digital switch 43 until zero is reached, and then issues the underflow pulse U to cut off the flow of forward-rotation pulses. The end result is that only the predetermined amount of liquid is taken up by the single action of the piston.

In the foregoing it is necessary to again preset the counter 45 following the generation of the underflow pulse. This is performed by the preset load signal generating circuit 47 which responds to the underflow pulse U by loading the value set on the digital switch into the preset counter 45 in anticipation of the next pulse train from the uptake gating circuit 40. Further, the underflow pulse is coupled to the OR gate 30 in the repetition control means 14 as a signal $S_e$ indicating completion of the uptake operation. At this particular point in time, however, AND gate 32 will be closed since the output of gating circuit 52 is low, as previously described. The generation of the signal $S_e$ therefore causes neither an uptake nor a discharge stroke.

When the operator depresses the push-button switch 26 again, the drive command signal pulse $S_d$ is produced and coupled to the discriminatory command means 12 through the repetition control means 14, just as described hereinabove. The pulse counts the content of preset counter 33 down to the value "1" and, as before, the uptake gating circuit 40 is open to deliver the pulse to the uptake gating circuit 40, whereby the pulsed motor 24 is rotated the preset amount to effect the uptake of the preset amount of liquid, in exactly the same manner as described previously. When the operator depressed the push-button switch 26 a third time, the foregoing series of operations is repeated to take up a preset amount of liquid a third time, with the content of preset counter 33 being counted down to zero from its original value of "3". When the push-button switch 26 is depressed one more time, therefore, the preset counter 33 produces the underflow pulse U, in response to which AND gate 34 is closed and AND gate 35 opened. In consequence, the drive command pulse $S_d$ coupled to the AND gates 34, 35 via the delay circuit 38 is passed solely by the AND gate 35 and enters the piston stroke control means 13 as a discharged command signal $S_d$ which gates the discharge gating circuit 41 open. This permits the passage of the pulse train from the pulse train generating circuit 42 to the reverse-rotation input terminal 25*b* of the pulsed motor driver 25 which responds by rotating the pulsed motor 24 in the reverse direction. The piston 1B is thus advanced to discharge the liquid from the piston 1 into the awaiting vessel. The amount of liquid discharged is controlled in the same fashion as described in connection with the uptake operation. Specifically, when the content of preset counter 46 is counted down to zero, indicating that the amount of uptake set by the digital switch 43 has been attained, the counter issues an underflow pulse U which closes the discharge gating circuit 41, cutting off the supply of reverse-rotation pulses to pulsed motor driver 25. This terminates the discharge operation and simultaneously loads the preset value into the counter 46 from the digital switch 44.

Thus it may be appreciated that when the push-button switch 26 is depressed successively, the first three of such actions result in uptake strokes and the fourth causes a discharge stroke. Note also that since the discharge command signal $S_b$ from the output of the AND gate 35 is applied also to the preset load signal generating circuit 39 to again load the preset value ("3" in this example) into the preset counter 33, another cycle composed of three uptake strokes and one discharge stroke can be implemented by the fifth through eighth operations of the push-button switch 26. This cycle can be repeated as often as desired.

The operation of the discriminatory command means 12 and piston control means 13 proceeds in the same manner as described even when the repetition control means 14 is deleted, that is, even when the output terminal of the Schmitt trigger buffer circuit 29 in drive command signal generating means 10 is connected directly to the input terminal 12*a* of the discriminatory command means 12.

In the foregoing description it was assumed that the repetition number setting switch 49 in repetition control means 14 was set to zero. Now, however, assume that the setting is for an integral number than zero, such as the number "5". When the push-button switch 26 is depressed the first time an uptake stroke is executed in the manner described, and the drive command pulse $S_d$ is applied to the preset counter 50 through the OR gate 53. Unlike the former case where the content of the counter 50 was zero, the pulse $S_d$ is capable of decrementing the counter, to the value "4" in the present case, so no underflow pulse is generated. The output of gating circuit 52 therefore remains high, so AND gate 32 is held open. This means that when the preset counter 45 produces an underflow pulse, namely the signal $S_e$, upon the completion of an uptake stroke by the piston 1B, this signal will be coupled as a drive command signal $S_a$, to the input terminal 12*a* of the discriminatory command means 12 through the OR gate 30, delay circuit 31 and the now open AND gate 32, whereby the second uptake stroke is effected automatically. The third uptake stroke follows automatically through the same series of operations, and then a fourth stroke, namely the discharge stroke. In the execution of the discharge stroke the underflow pulse produced by the preset counter 33 in the discriminatory command means 12 is inverted by the inverter 37 and then applied to the count-down input terminal of the preset counter 50 through the OR gate 53, whereby the content of counter 50 is counted to "3". When the abovementioned discharge stroke is completed and the preset counter 46 produces an overflow pulse, namely the signal $S_f$, the signal is applied to the OR gate 30 to initiate the first uptake stroke of the second cycle. Thereafter third through fifth cycles are initiated and implemented just as described above, and fully automatically. In the execution of the fourth action in the fifth cycle, namely the discharge stroke, the inverted underflow pulse from the preset counter 33 again enters the preset counter 50 through the OR gate 53. Since the content of counter 50 is now zero, however, the counter delivers an underflow pulse U to the GATE OFF terminal of the gating circuit 52, the output of the gating circuit goes low, and AND gate 32 is closed. Following completion of the last discharge stroke in the fifth cycle, therefore, no further uptake of discharge operations can take place until the operator again depresses the push-button switch 26. In other words, merely depressing the push-button switch 26 once makes it possible to execute one cycle, or to repeat the cycle automatically two or more times, where one cycle may consist of a plurality of uptake strokes and a subsequent discharge stroke.

There are many cases where the liquid specimens previously induced into the cylinder 1 by a plurality of uptake strokes are required to be discharged from the cylinder in their entirely by a single discharge stroke. When such is indeed the case it is necessary to set the liquid discharge quantity so as to be equivalent to the arithmetic product of the single uptake stroke quantity which is set by digital switch 43, and the number of uptake strokes set by the digital switch 36. In order to expedite the setting of the proper liquid discharge quantity, it is advantageous if the arrangement is such that the numerical value corresponding to the product of the single uptake stroke quantity and the number of uptake strokes is computed automatically and then preset in the preset counter 46, also automatically. With such an arrangement it would be possible to delete the digital switch 44, which specifies the discharge quantity.

It will be noted in FIG. 4 that the drive command signal generating means 10 of the control unit 9 is provided with the external signal input terminal 27 mentioned earlier in this discussion. A pulse applied to this terminal will be delivered to the Schmitt trigger buffer circuit 29 through the OR gate 28 and result in the generation of the drive command signal $S_a$. Accordingly, if the terminal 27 is connected to auxiliary equipment, uptake and discharge operations can be initiated automatically in association with the auxiliary equipment, or upon completion of a particular task executed by such equipment.

Further, the earlier mentioned external output terminal 101 is provided in the line which is connected to the output terminal for the underflow pulse from the preset counter 46 in piston stroke control means 13. The terminal 101 permits the discharge completion signal $S_f$ to be extracted from the control means 13 so that an auxiliary piece of equipment can be started automatically upon the completion of a discharge stroke, as mentioned earlier with reference to FIG. 2.

Figure 5:
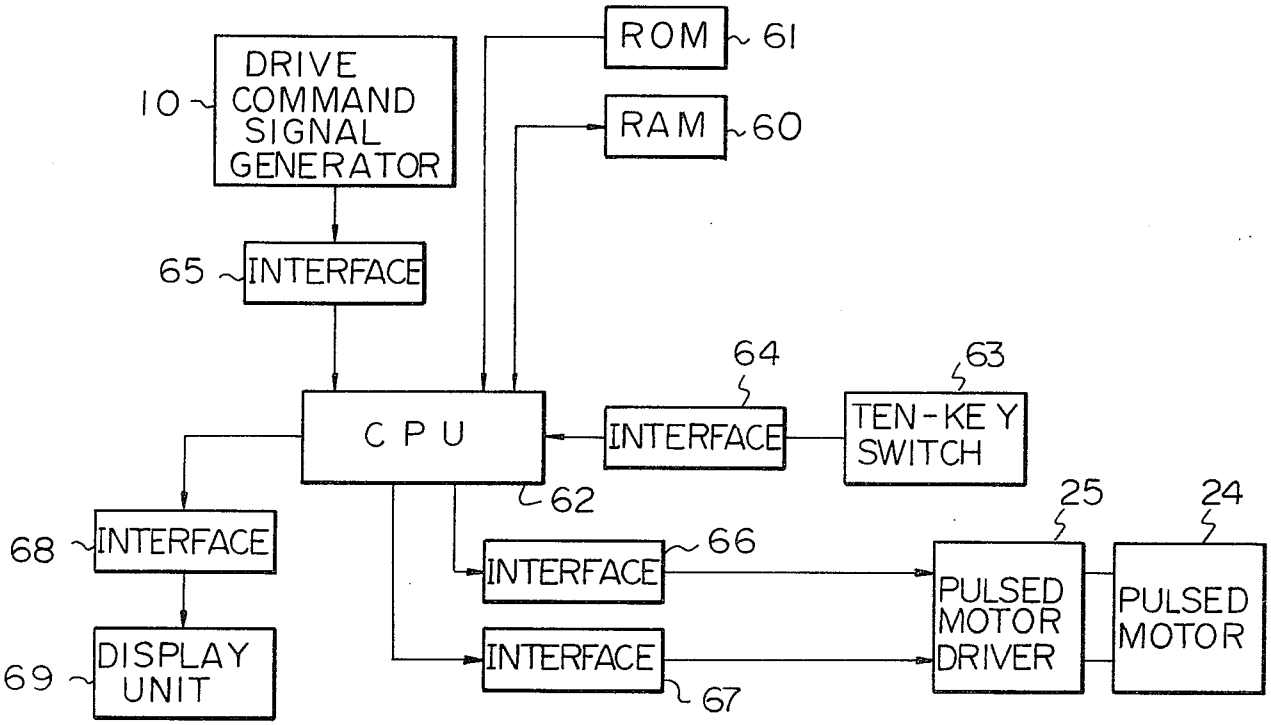
FIG. 5 is a block diagram illustrating the control unit in a second embodiment of the present invention.

FIG. 5 illustrates the control unit 9 in a second embodiment of the liquid specimen uptake and discharge apparatus of the present invention. In this embodiment a microcomputer is employed as the control unit. Specifically, there is provided a random access memory (referred to hereinafter as a RAM) 60 for storing such items of information as (a) the value which specifies the number of uptake strokes set by the operator, (b) a counted value which indicates the actual number of uptake strokes performed, (c) the values which specify the uptake and discharge quantities, and (d) the value which specifies the repetition number for the above-mentioned cycle or series of operations consisting of a plurality of uptake strokes and a subsequent discharge stroke. Also provided is a read-only memory (referred to hereinafter as a ROM) 61 which holds the processing program to be executed by a central processing unit (CPU) 62. The aforementioned values (a), (c) and (d) are written into the RAM 60 by punching the keys on a ten-key switch 63, with the data entering the RAM 60 through an interface 64 and the CPU 62. The drive command signal generating means 10 may comprise a manually operable switch such as the push-button switch employed in the first embodiment of the invention, and feeds its output signal $S_d$, namely the drive command signal, into the CPU 62 through an interface 65. The CPU 62, by executing the program stored in the ROM 61, performs the functions of the repetition control means 14, discriminatory command means 12 and the piston stroke control means 13 illustrated in FIGS. 2 and 4. It may be so arranged that the outputs of the CPU 62 are coupled to the pulse motor driver 25 as the forward-rotation and reverse-rotation pulse trains through interfaces 66, 67. It is advantageous also if the CPU 62 is connected to a display unit 69 through an interface 68 in order to display the number of uptake strokes, the number of repetitions, the uptake and discharge quantities and the like.

It will be appreciated, therefore, that the RAM 60, ROM 61, CPU 62 and ten-key switch 63 in FIG. 5 in effect constitute the uptake stroke number setting means 11, the discriminatory command means 12, piston stroke control means 13 and repetition number control means 14 shown in FIG. 2.

Figure 6:
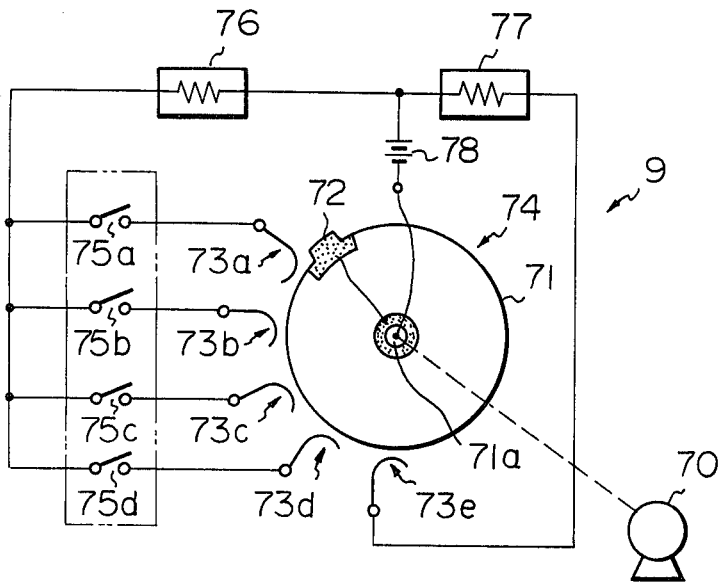
FIG. 6 is a simplified connection diagram illustrating the control unit in a third embodiment of the present invention.

FIG. 6 illustrates the control unit 9 in a third embodiment of the present invention. Here a portion of the control unit 9 makes use of a mechanical mechanism, in which a rotary member 71, having a contact 72 on its outer periphery, is rotatively driven by a motor 70. Three or more equally spaced-apart contacting pieces 73*a*, 73*b*, 73*c*, 73*d*, 73*e* are disposed on the orbital path traversed by the contact 72. Thus the rotary member 71, contact 72 and contacting pieces 73*a* through 73*e* construct a drivable rotary switch 74. Among the foregoing contacting pieces, 73*a* through 73*d* are connected to one end of a motor driver 76 for forward rotation, through respective switches 75*a* through 75*d*. The remaining contacting piece 75*e* is connected directly to one end of a motor driver 77 for reverse rotation. The other ends of the motor drivers 76, 77 are connected commonly to one pole of a power supply 78, whose other pole is connected to the contact 72 through the central shaft 71*a* on which the rotary member 71 is mounted. The motor driver 76 for forward rotation may, by way of example, constitute the driver of a DC motor (not shown) for retracting the piston 1B in FIG. 1 in order to perform an uptake stroke. Likewise, the other motor driver 77 for reverse rotation would constitute the driver of a DC motor (not shown) for advancing the piston 1B in order to execute a discharge stroke.

In operation, assume that the operator has closed switches 75*a* and 75*b* (the bank of switches 75*a* through 75*d* corresponding to the manually operable uptake stroke setting means 11, as will be set forth below). Under these conditions, assume further that the rotary member 71 is driven counterclockwise from the illustrated position by actuating the motor 70. This will bring contact 72 into electrical contact first with the contacting piece 72, whereby power is supplied to the forward-rotation motor driver 76 from the power supply 78. The forward-rotation motor (not shown) is thus driven into rotation, retracting the pistoon 1B to induce a liquid specimen into the cylinder body 1A. Next, when the rotary member 71 continues to be rotated counter-clockwise, contact 72 makes contact with the contacting piece 73*b* and another uptake stroke is executed just as described above. Since switches 75*c*, 75*d* are open, further counter-clockwise rotation of the rotary member 71 does not actuate the forward-rotation motor driver 76. Eventually, however, contact 72 will meet contacting piece 73*e*, supplying power to the reverse-rotation motor driver 77 which responds by rotating the reverse-rotation motor (not shown) in order to advance the piston 1B and discharge the liquid specimens, previously induced into the cylinder body 1A, into an awaiting vessel.

It will be understood from the foregoing that the number of closed switches in the bank of switches 75*a* through 75*d* determines the number of uptake strokes; hence, these switches correspond to the uptake stroke setting means 11 of FIG. 1. Further, the overall rotary switch 74 corresponds to the drive command signal generating means 10 in FIG. 1, since the uptake and discharge operations are initiated by a signal produced by contact between the contact 72 and individual ones of the contacting pieces 73*a* through 73*e*. Also, since the uptake and discharge operations are executed in discriminatory fashion depending upon the relationship of the wiring connections for the contacting pieces 73*a* through 73*e*, the rotary switch 74 and the particular wiring connection relationship established by the rotating contact 72 correspond to the discriminatory command means 12 of FIG. 1.

The rotary switch 74 shown in FIG. 6 is illustrated as being a contact-type switch for convenience sake, though it goes without saying that various contactless switch or reed switch configurations can be adapted. In addition, it has been described that the rotary member 71 is driven by the motor 70. It is obvious that the rotary member 71 can be adapted for manual rotation. Furthermore, in the embodiment of FIG. 6 the piston 1B is driven by a DC motor which is in turn driven by the drivers 76, 77. Such an arrangement is illustrated for the purpose of simplifying the description, however, and it is possible to adopt an alternative arrangement in which the forward- and reverse-rotation drivers 76, 77 are replaced by forward- and reverse-rotation pulse train generating circuits which supply their outputs to a pulsed motor, rather than a DC motor, for the purpose of driving the piston 1B.

Figure 7:
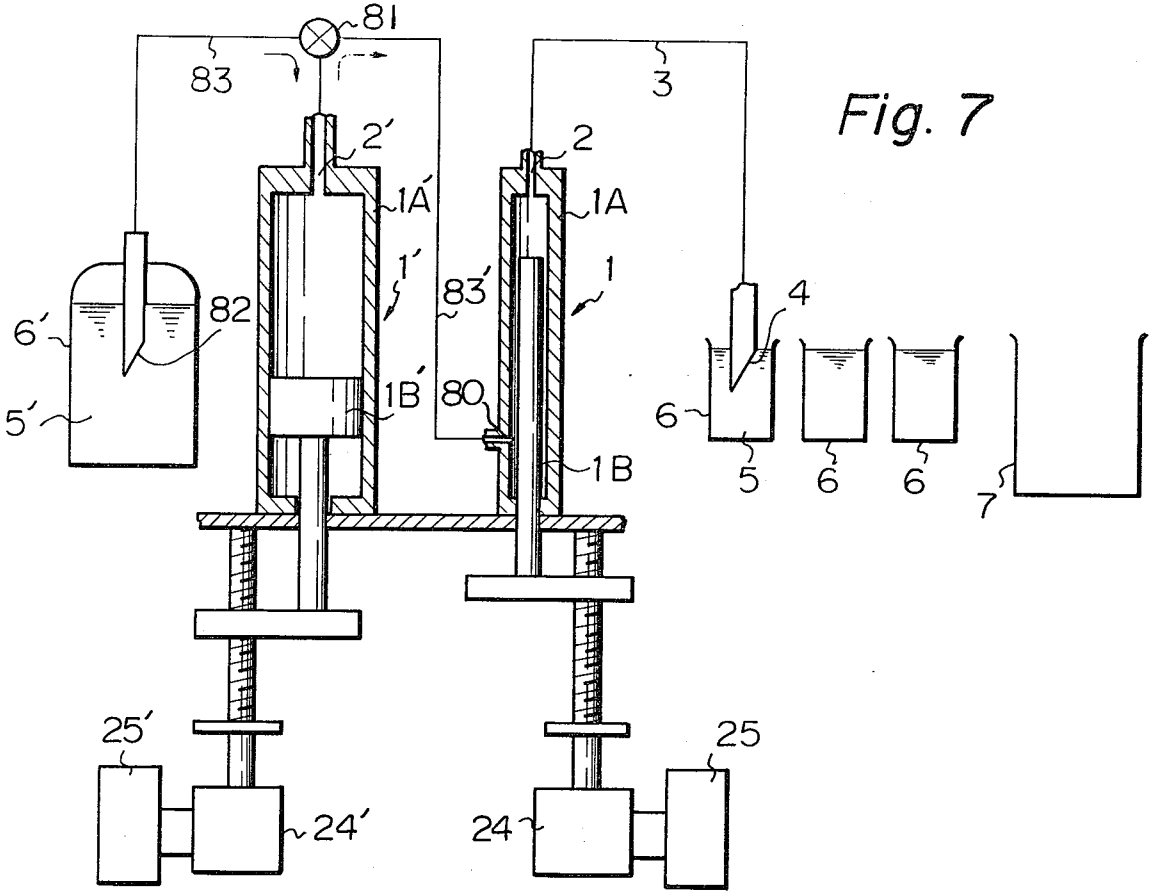
FIG. 7 illustrates a simplified and partially cut-away front view of a fourth embodiment of the liquid uptake and discharge apparatus according to the present invention, in which the mechanical part of the apparatus is shown.
Figures 8, 8A, 8B, 8C:
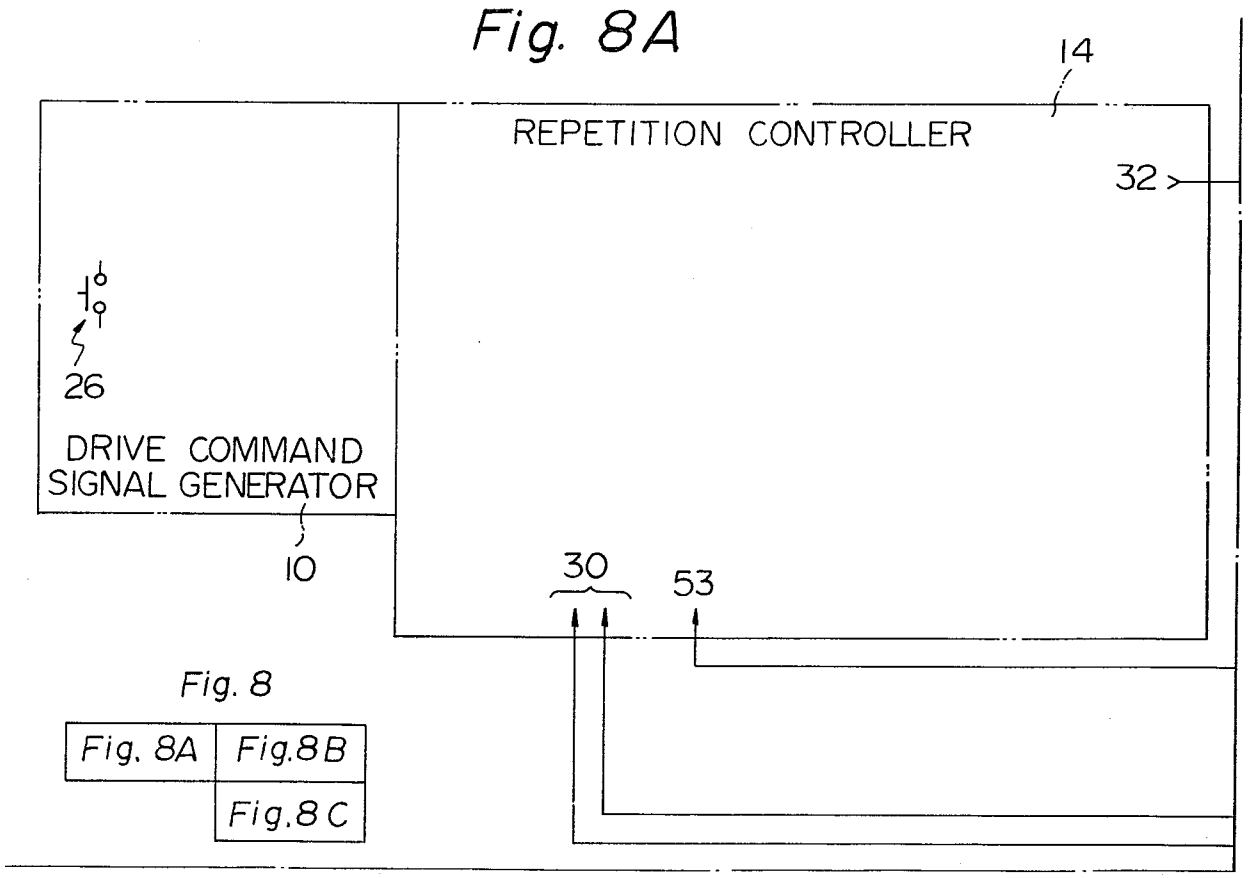
FIG. 8 is a block circuit diagram of a control unit, constituting part of the electrical circuitry of the apparatus, the block diagram being divided into three parts, namely, FIGS. 8A, 8B and 8C.
Figure 8B:
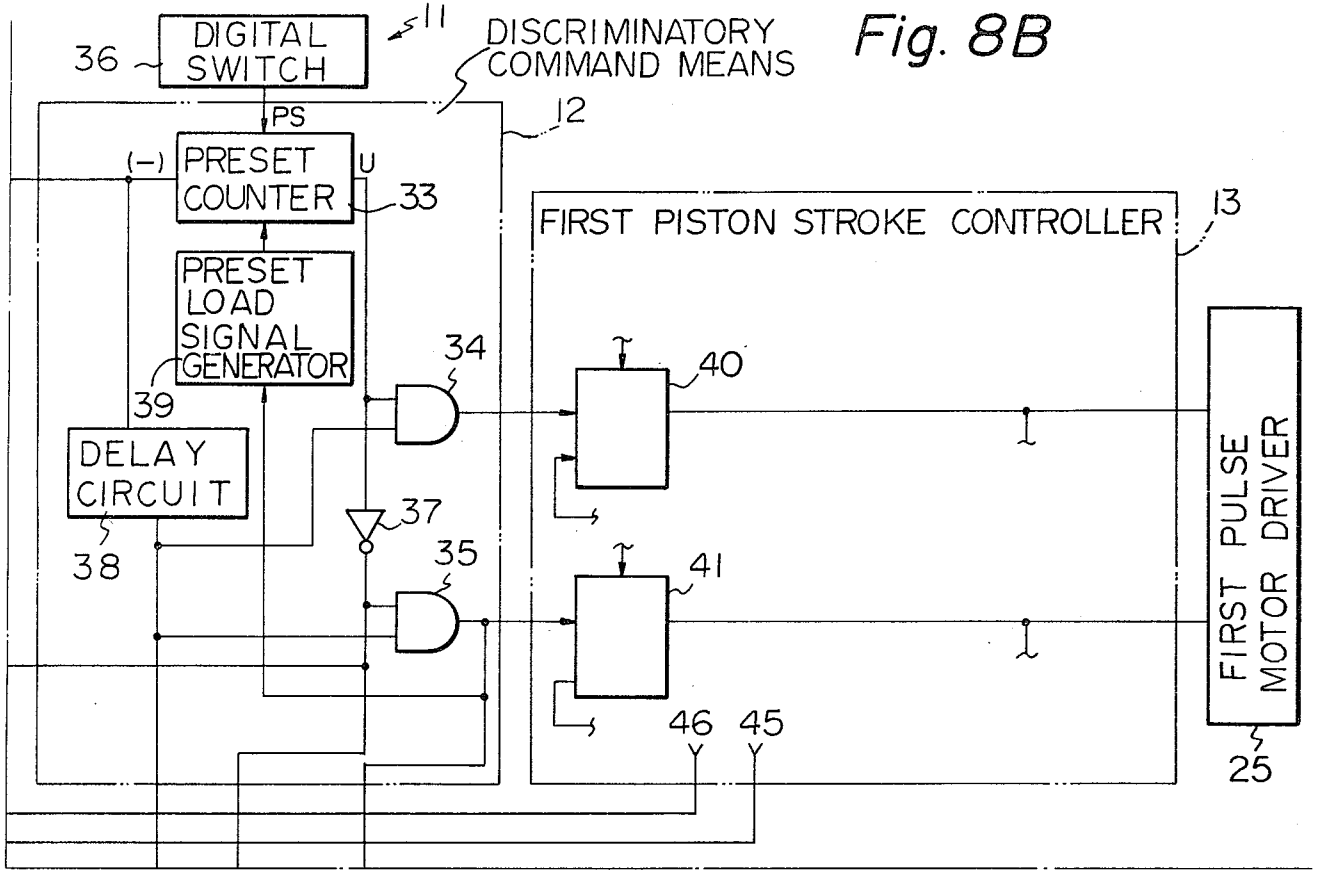
Figure 8C:
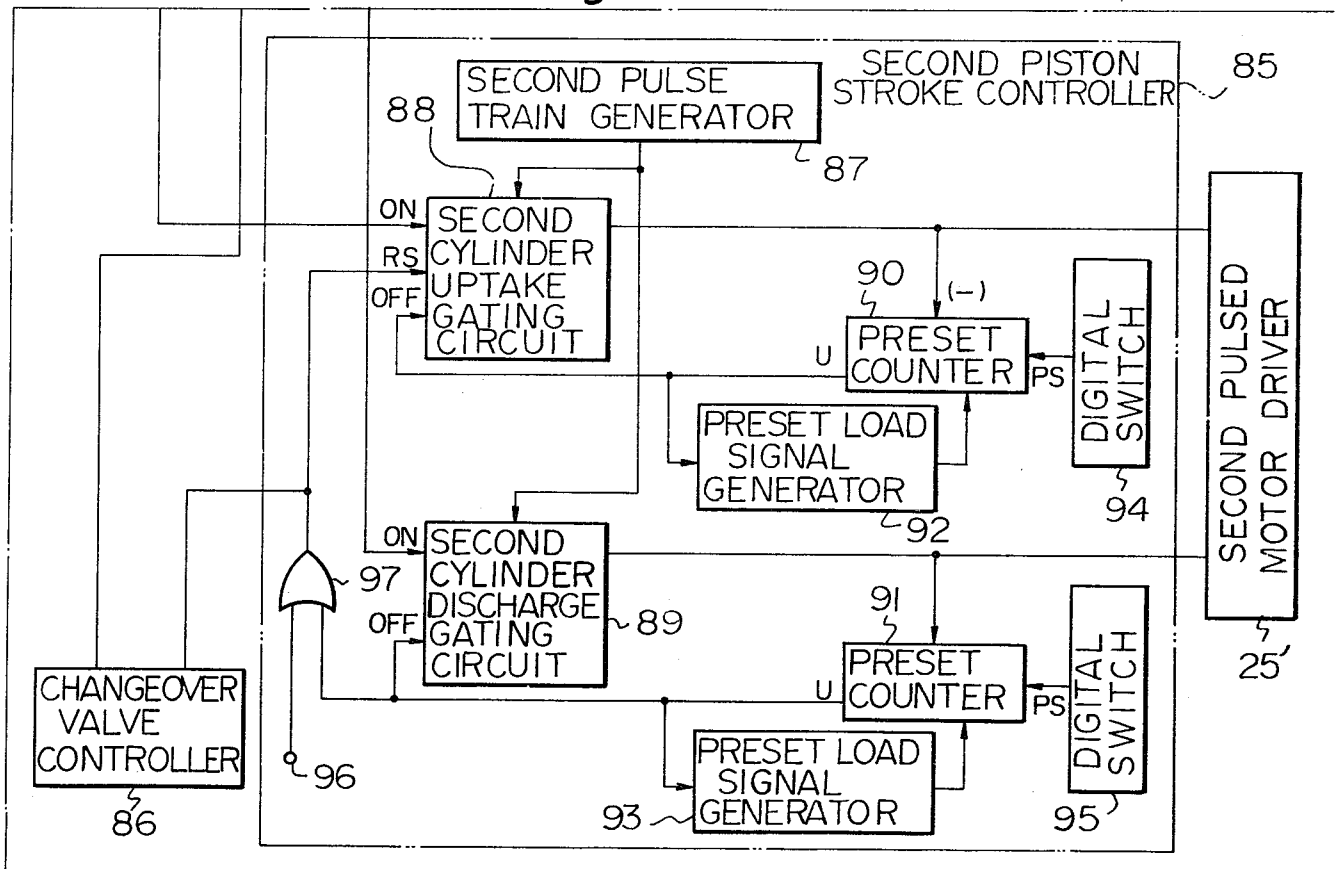

In a fourth embodiment of the present invention, as illustrated in FIGS. 7 and 8, two piston cylinders 1, 1' are provided. Reference will first be had to FIG. 7 which shows the mechanical or structural features of the set-up.

Cylinder body 1A of piston cylinder 1, referred to hereinafter as the first piston cylinder, has one end thereof formed into the uptake and discharge port 2, and includes an injection port 80 formed in its wall at a location remote from the uptake and discharge port 2. The latter is coupled to the probe having the uptake and discharge opening 4 via the coupling hose 3, as in the arrangement of FIG. 1.

It should be noted that the second cylinder 1' has an effective interior volume which is greater than that of the first piston cylinder 1. The second cylinder 1' has a cylinder body 1A' whose one end is formed into an uptake and discharge port 2'. The latter is connected, through a change-over valve 81, to a probe having an uptake opening 82 which is coupled to the valve 81 via a coupling hose 83, and to the injection port 80 of the first cylinder 1 via a coupling hose 83' which is also connected to the valve 81. The uptake and discharge port 2' of the second cylinder 1' may thus be connected selectively to the uptake opening 82 or to the injection port 80 by means of the changeover valve 81. The probe having the uptake opening 82 is designed to dip into a liquid 5', which may be a diluent, contained in a vessel 5'.

The pistons 1B, 1B' of the respective piston cylinders 1, 1' are adapted to be advanced and retracted by respective first and second pulsed motors 24, 24' serving as the drive unit 8. The pulsed motors 24, 24' are rotated in the forward or reverse direction by forward- or reverse-rotation pulse trains applied to respective drivers 25, 25'. The construction and operation to achieve the above are as described in connection with the foregoing embodiments. This will become more apparent from FIG. 8 showing the relevant electrical circuitry, specifically the control unit for controlling the first and second pulsed motors 24, 24'.

In FIG. 8, the control unit 9 includes the circuitry for controlling the first pulsed motor 24, namely the circuitry which impresses the forward- and reverse-rotating pulse trains upon the first pulse motor driver 25. This circuitry comprises the drive command signal generating means 10, repetition control means 14, uptake stroke number setting means 11, discriminatory command means 12 and the piston stroke control means 13. Since these means 10, 14, 11, 12 and 13 are structurally and functionally identical with those illustrated in FIG. 4, they need not be described again here. The characterizing feature of this embodiment resides in the provision of second piston stroke control means 85 and changeover valve control means 86.

The second piston stroke control means 85 includes a pulse train generating circuit 87 whose pulses drive the second pulsed motor 24', a second cylinder uptake gating circuit 88 and a second cylinder discharge gating circuit 89 for controlling the delivery of the pulse train from the circuit 87, preset countters 90, 91, preset load signal generating circuits 92, 93, a digital switch 94 for specifying the amount of liquid to be taken up by the second cylinder 2, a digital switch 95 for specifying the amount of liquid to be discharged from the second cylinder, and an OR gate 97. According to the illustrated arrangement, the second cylinder uptake gating circuit 88 is locked in the closed or "off" state by the arrival of a signal at its OFF terminal, and will not open or be turned on even when a signal is applied to its ON terminal. However, the arrival of a signal at the reset terminal will unlock the gating circuit 88 and place it in a mode where it can be turned on by a signal applied to its ON terminal.

The changeover valve control unit 86 is adapted to couple a signal to the changeover valve 81 in FIG. 7, the valve responding by switching between the coupling hose 83 or 83'.

In operation, assume that a reset signal has been applied beforehand to the reset terminal of the uptake gating circuit 88, the signal being fed in manually or automatically from the outside via a reset signal input terminal 96. Assume also that the changeover valve control unit 86, which likewise has received the reset signal from the input terminal 96, has responded by switching the changeover valve 81 so as to communicate the uptake and discharge port 2' of the second cylinder 1' with the coupling hose 83 that leads to the probe having the opening 82. When the operator depresses the push-button switch 226 of the drive command signal generating means 10 under these conditions, the first drive command signal pulse is generated. As with the circuitry in FIG. 4, this causes the preset number of forward-rotation pulses to enter the first pulsed motor driver 25, whereby the preset amount of liquid 5 is induced into the first piston cylinder 1 from a vessel 6, via the coupling hose 3 whose probe is dipped in said liquid. At the same time, the drive command pulse is coupled to the ON terminal of the second cylinder uptake gating circuit 88 via the delay circuit 38 in the discriminatory command means 12, whereby the gating circuit 88 is turned on or opened to deliver the pulse train from the pulse train generating circuit 87 for the second pulsed motor 24. The pulse train is applied to the second pulsed motor driver 25' as the forward-rotation pulse train. As a result, the second piston cylinder 1' also executes an uptake stroke and takes up the liquid 5', such as a diluent, from the vessel 6'. The liquid flows into the second piston cylinder 1' through the uptake opening 82, coupling hose 83 and changeover valve 81. The amount of uptake is determined by the digital switch 94 through an operation identical with that illustrated and described in connection with FIG. 4. When the preset amount of liquid 5' has been taken up, the preset counter 90 issues an underflow signal U which enters the OFF terminal of gating circuit 88 and locks this circuit in the off state, cutting off the flow of forward-rotation pulses coupled to the second pulsed motor driver 25'. Thus, when the operator depresses the push-button switch 26 the first time, the first piston cylinder 1 takes up a predetermined amount of the liquid specimen 5, and the second piston cylinder 1' takes up a predetermined amount of the liquid 5'. Then, when the operator depresses the push-button switch 26 a second time, or upon the completion of the first uptake stroke as just described, the first piston cylinder 1 repeats the uptake action, as explained previously with reference to FIG. 4. Since the gating circuit 88 is locked in the off state, however, the second piston cylinder 1' does not respond and remains inoperative. At same time thereafter the preset counter 33 in discriminatory command means 12 will produce an underflow pulse. This will occur in concurrence with the n−th ($n \geqq 3$) operation of the push-button switch 26, or upon completion of the (n−1)−th uptake stroke of the first piston cylinder 1. The pulse is applied to the changeover valve control unit 86 through the inverter 37, whereby the changeover valve 81 is actuated to connect the uptake port 2' of the second piston cylinder 1' to the coupling hose 83' which leads to the injection port 80 of the first piston cylinder 1. Following this the AND gate 35 issues the discharge command signal which is applied to the respective ON terminals of the discharge gating circuit 41 in the first piston stroke control means 13 and the discharge gating circuit 89 in the second piston stroke control means 85, whereby the gating circuits 41, 89 are turned on, or opened. In consequence, the reverse-rotation pulse train is applied to the first pulsed motor driver 25 and second pulsed motor driver 25', so that both piston cylinders 1, 1' execute a discharge stroke. Thus the liquid previously induced into the second piston cylinder 1' is expelled into the first piston cylinder 1 through the coupling hose 83', and the liquid contained in the first piston cylinder 1 is discharged into the vessel 7 through the coupling hose 3. It follows then that when different liquid specimens are taken up in the first piston cylinder 1 from the vessels 6 and a diluent is induced into the second piston cylinder 1' from the vessel 6', the liquid eventually discharged from the first piston cylinder by the discharge stroke will be the mixture of different liquid specimens diluted with the diluent.

The amount of liquid discharged by the second piston cylinder 1' in the foregoing operation is determined by the setting on the digital switch 95. When the discharge of the set amount of liquid has ended, the preset counter 91 produces an underflow pulse which is applied to the OFF gate of second cylinder discharge gating circuit 89 to gate the circuit closed, and to the reset terminal of the second cylinder uptake gating circuit 88 via the OR gate 97, whereby the gating circuit 88 is unlocked. The pulse delivered by the OR gate 97 is applied also to the changeover valve control unit 86 which now restores the changeover valve 81 to the original state, so that the uptake and discharge port 2' thereof is connected to the coupling hose 83. It should be noted that the series of operations described hereinabove can be repeated a plurality of times automatically as already described with reference to FIG. 4.

It should be obvious from the foregoing that the present invention can be applied to an uptake and discharge apparatus having one or a plurality of piston cylinders. In the case where a plurality of the piston cylinders are combined, an arrangement may be adopted in which at least one of the piston cylinders is so controlled as to discharge its contents after a plurality of uptake strokes, in the manner described above. Obviously two or more of the piston cylinders can each be controlled in this fashion.

Figure 9:
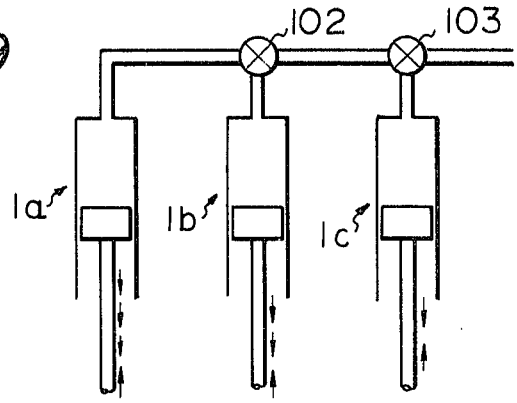
FIG. 9 is a simplified schematic view showing a modification of the piston cylinder uptake and discharge path.

In another possible modification in which the apparatus includes a plurality of piston cylinders, the mode of interconnection can be set at will depending upon the particular use of the apparatus. For example, in FIG. 9 the uptake and discharge apparatus is provided with a first piston cylinder 1*a* which is adapted to make a plurality of uptake strokes and a discharge stroke, a second piston cylinder 1*b* which, likewise, makes a plurality of uptake strokes (though the number of such strokes need not be the same as that for the first piston cylinder) and a discharge stroke, and a third piston cylinder 1*c* which is adapted to make one uptake stroke and one discharge stroke. These three cylinders can be connected in parallel by changeover valves 102, 103.

Figure 10:
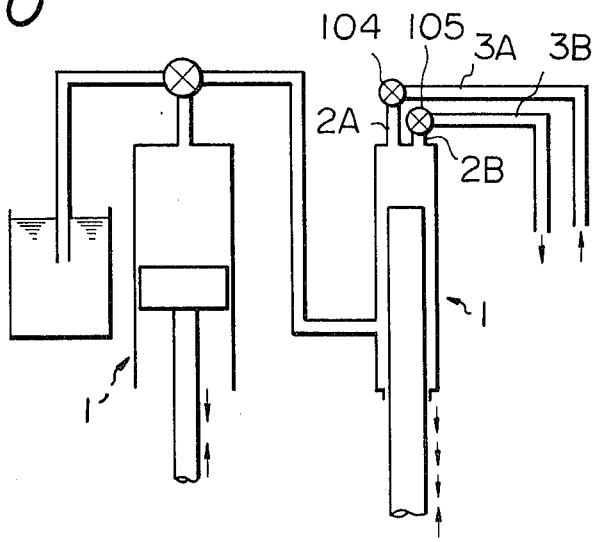
FIG. 10 illustrates another modification of the piston cylinder uptake and discharge path.

When it is desired to achieve full automation of the uptake and discharge operations or more complete mixing of different liquid specimens, a particularly advantageous arrangement is to construct separate uptake and discharge passages and to open or close these passages by means of valves in synchronization with piston cylinder operation. FIG. 10 illustrates an example in which this concept is applied to the arrangement of FIG. 7. It will be seen that the upper end of the first piston cylinder 1 has separate uptake and discharge ports 2A, 2B, respectively, and that these ports are connected to corresponding coupling hoses 3A, 3B through respective on-off valves 104, 105. A liquid specimen is induced into piston cylinder 1 through coupling hose 3A and on-off valve 104, and a liquid mixture is discharged from the piston cylinder through ten on-off valve 105 and coupling hose 3B, the valves being switched accordingly.

Figure 11:
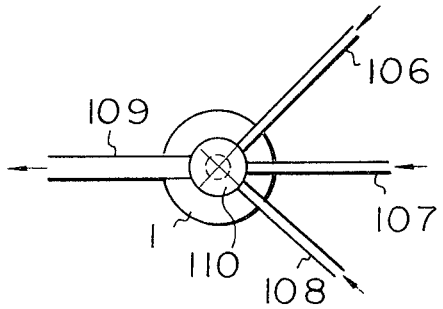
FIG. 11 is a further modification of the piston cylinder uptake and discharge path.

Another arrangement which adopts a technique similar to that just described is depicted in FIG. 11. Here the piston cylinder 1, which is adapted to make a plurality of uptake strokes followed by a discharge stroke, is provided with a changeover valve 110 for selectively connecting three uptake paths 106, 107, 108 and a discharge path 109 to its uptake and discharge port 2. Actuating the changeover valve 10 for each uptake stroke and for each discharge stroke successively connects a different path to the piston cylinder to enable the desired sequence of uptake and discharge operations.

It will be apparent from the foregoing description that the liquid uptake and discharge apparatus of the present inventiohn enables liquid specimens to be taken up a plurality of times and then discharged, and therefore makes it possible to sample a plurality of different specimens, to mix the specimens, and to dilute the mixture when so desired, through a series of very simple operations and with an apparatus that is simply constructed. This shortens operation time, simplifies the operator's tasks and reduces the probability of error. It should be noted that the apparatus of the invention can be applied to wash a closed flow path, as in the case of an analyzer which uses a flow cell.

As many apparently widely different embodiments of the present invention can be made without departing from the spirit and scope thereof, it is to be understood that the invention is not limited to the specific embodiments thereof except as defined in the appended claims.

What is claimed is:

1. An apparatus for taking up and discharging liquid, which comprises at least one piston cylinder which functions to take up and discharge liquid, a drive unit for actuating said piston cylinder, and a control unit for controlling said drive unit, said control unit including signal generating means for generating a drive command signal in response to which said piston cylinder executes a liquid uptake or discharge operation, setting means for setting the number of liquid uptake operations to be executed by said piston cylinder, and discriminatory command means for producing an uptake command signal in response to the drive command signal until the number of said drive command signals arriving from said signal generating means reaches the number of liquid uptake operations set by said setting means, and for producing a discharge command signal in response to the drive command signal when the number of said drive signals exceeds said set number of liquid uptake operations.

2. An apparatus for taking up and discharging liquid as described in claim 1 characterized in that said control unit comprises said drive command signal generator, said uptake number setting means, said discriminatory command means, and a piston stroke controller.

3. An apparatus for taking up and discharging liquid as described in claim 1 or 2 characterized in that said control unit includes repetition controller means for controlling a series of operations preset by said uptake number setting means and said discriminatory command means so as to repeat said series of operations.

4. An apparatus for taking up and discharging liquid as described in any one of claims 1 or 2 characterized in that said drive command signal generator means is a switch.

5. An apparatus for taking up and discharging liquid as described in any one of claims 1 or 2 characterized in that said drive command signal generator means includes a switch, and a Schmitt trigger buffer circuit.

6. An apparatus for taking up and discharging liquid as described in any one of claims 1 or 2 characterized in that said drive command signal generator means includes a push-button switch, an OR gate adapted to receive either a signal produced by depressing said push-button switch or a signal from the external, and a Schmitt trigger buffer circuit actuated by the output of said OR gate.

7. An apparatus for taking up and discharging liquid as described in any one of claims 1 or 2 characterized in that said uptake number setting means is a switch capable of disposing spatially movable contracts available for numbers corresponding to numbers of uptake strokes.

8. An apparatus for taking up and discharging liquid as described in any one of claims 1 or 2 characterized in that said uptake number setting means is a switch for generating electric signal code corresponding in number to uptake strokes.

9. An apparatus for taking up and discharging liquid as described in any one of claims 1 or 2 characterized in that said discriminatory command means is a switch so disposed as to render a contact for generating said discharge command signal available after a contact corresponding in number to uptake strokes is made available.

10. An apparatus for taking up and discharging liquid as described in any one of claims 1 or 2 characterized in that said discriminatory command means provide a function of comparing uptake strokes set by said uptake number setting means with frequency of drive command signal generation and another function of signal generation for generating either an uptake command signal or a discharge command signal in response to the result of said comparison.

11. An apparatus for taking up and discharging liquid as described in any one of claims 1 or 2 characterized in that said discriminatory command means includes a preset counter whose content is counted down by a signal which arrives from said drive command signal generating means via said repetition controller means, said preset counter being preset to the number of uptake strokes set by a digital switch which serves as said uptake number setting means, said discriminatory command means having a first AND gate of which a first input terminal receives an underflow signal of said preset counter and a second AND gate of which a first input terminal receives a signal which is the inverse of said underflow signal of said preset counter, inverted by an inverter, a second input terminal each of said first and second AND gates being such as to receive an output signal from said repetition controller means.

12. An apparatus for taking up and discharging liquid as described in any one of claims 1 or 2 characterized in that said discriminatory command means comprises a central processing unit having an operation decision function, a random access memory (RAM) for temporarily storing a numerical value, and a read only memory to receive therein a program so prepared that said central processing unit initially renders uptake strokes receptive to said RAM, and that 1 is substracted from said numerical value received in said RAM whenever said drive command signal is applied, such numerical value being again received in said RAM, and that an uptake command signal is produced to then wait a next drive command signal when the result of said substraction is more than a predetermined threshold whereas a discharge command signal is produced when the result of said substraction is less than said predetermined threshold.

13. An apparatus for taking up and discharging liquid as described in any one of claims 1 or 2 characterized in that said drive unit is a pulse motor, a drive shaft of said pulse motor being coupled to a piston of said piston cylinder, a driver of said pulse motor being adapted to receive a pulse train for forward rotation of said pulse motor, generated by said control unit or a pulse train for reverse rotation thereof, said pulse motor being rotated by these pulse trains in a predetermined direction a predetermined angle.

14. An apparatus for taking up and discharging liquid as described in claim 3 characterized in that said control unit includes repetition control means on an output side of said Schmitt trigger buffer circuit of said drive command signal generator means, said repetition control means comprising a digital switch for setting the number of repetitions of a series of operations consisting of a plurality of uptake strokes and a subsequent discharge stroke, a preset counter to the number of repetitions set by said digital switch, and a gating circuit to receive an underflow output of said preset counter.

15. An apparatus for taking up and discharging liquid as described in any one of claims 1, 2 or 14 characterized in that said control unit includes piston stroke control means on an output side of said discriminatory command means, an output of said first AND gate being connected to a GATE ON terminal of an uptake gating circuit of said piston stroke control means whereas an output of said second AND gate is connected to a GATE ON terminal of a discharge gating circuit of said piston stroke control means, said piston stroke control means comprising a pulse train generating circuit for generating a raw pulse train to drive said pulse motor, a digital switch for specifying uptake stroke quantity to set the amount of a liquid specimen taken up into said piston cylinder, a digital switch for specifying discharge stroke quantity to set the amount of liquid discharged from said piston cylinder, a first preset counter preset to a number of pulses that corresponds to the uptake quantity set by said uptake stroke quantity specifying digital switch, a second preset counter preset to a number of pulses that corresponds to the discharge quantity set by said discharge stroke quantity specifying digital switch, and preset load signal generating circuit for loading said two preset counters, respectively.

16. An apparatus for taking up and discharging liquid as described in claim 14 characterized in that said repetition control means includes an OR gate to which are applied underflow outputs produced by said first and second preset counters in said piston stroke control means.

17. An apparatus for taking up and discharging liquid according to claim 1, further comprising a second piston cylinder having an effective internal volume which is greater than that of said first piston cylinder.

18. An apparatus for taking up and discharging liquid according to claim 1, further comprising second and third piston cylinders each having a changeover valve for interconnecting said first, second and third piston cylinders, said first and second piston cylinders each being adapted to execute a plurality of uptake operations and then a discharge operation, said third piston cylinder being adapted to execute a single uptake operation and then a discharge operation.

19. An apparatus for taking up and discharging liquid according to claim 1 or claim 17, in which the first piston cylinder has an uptake port and a discharge port each of which is provided with an on-off valve.

* * * * *